US009669646B2

(12) United States Patent
Jones

(10) Patent No.: US 9,669,646 B2
(45) Date of Patent: Jun. 6, 2017

(54) GIFT CARD AND PAPER CRAFTING KIT

(71) Applicant: Celeste Kathleen Jones, Chicago, IL (US)

(72) Inventor: Celeste Kathleen Jones, Chicago, IL (US)

( * ) Notice: Subject to any disclaimer, the term of this patent is extended or adjusted under 35 U.S.C. 154(b) by 0 days.

(21) Appl. No.: 14/994,671

(22) Filed: Jan. 13, 2016

(65) Prior Publication Data

US 2016/0200132 A1 Jul. 14, 2016

Related U.S. Application Data

(60) Provisional application No. 62/103,361, filed on Jan. 14, 2015.

(51) Int. Cl.
*G09F 1/06* (2006.01)
*B42D 15/04* (2006.01)

(52) U.S. Cl.
CPC ..... *B42D 15/045* (2013.01); *G09F 1/06* (2013.01)

(58) Field of Classification Search
CPC G09F 1/06; G09F 1/04; B42D 15/042; B42D 15/045; A47F 5/112
See application file for complete search history.

(56) References Cited

U.S. PATENT DOCUMENTS 1,026,933 A * 5/1912 Shreve ..... B42F 7/06 229/303
1,673,144 A * 6/1928 George ..... B65D 27/00 206/299
2,108,343 A * 2/1938 McAllister ..... B65D 27/08 206/299
2,269,915 A * 1/1942 Porter ..... B65D 65/08 229/125.38
4,566,952 A * 1/1986 Sprintschnik ..... B41N 3/034 205/139
4,874,092 A * 10/1989 Lara ..... A45C 11/24 206/455
2007/0227929 A1* 10/2007 Mauerhan ..... A45C 11/16 206/488
2013/0062227 A1* 3/2013 Thuesen ..... A24F 27/00 206/103

* cited by examiner

*Primary Examiner* — Cassandra Davis
(74) *Attorney, Agent, or Firm* — Dunlap Bennett & Ludwig PLLC

(57) ABSTRACT

A paper crafting kit containing pre-cut and pre-folded pieces of cardstock, enabling the paper crafter to assemble an oversized decorative paper envelope for greetings and special life events. The envelope may be configured to contain a booklet of tabs for well-wishers to compose personal messages, which can ultimately be used as a gift or keepsake.

15 Claims, 3 Drawing Sheets

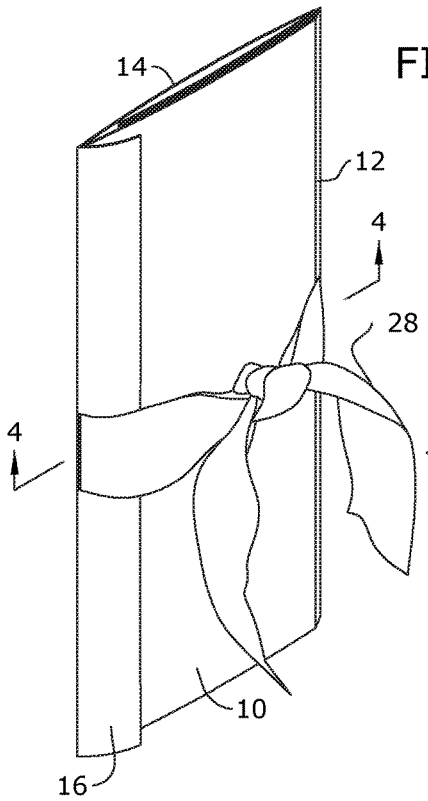
FIG.1
FIG.2A
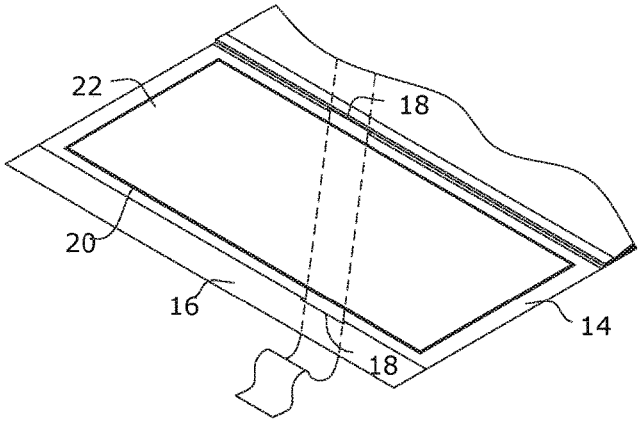
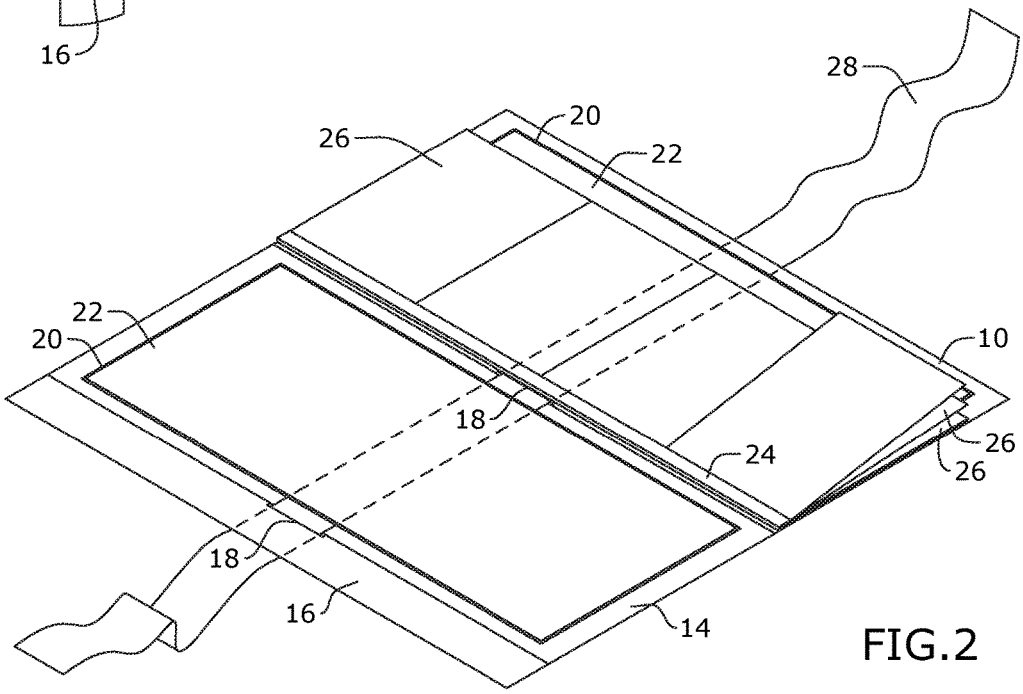
FIG.2

GIFT CARD AND PAPER CRAFTING KIT

CROSS-REFERENCE TO RELATED APPLICATION

This application claims the benefit of priority of U.S. provisional application Ser. No. 62/103,361, filed Jan. 14, 2015, the contents of which are herein incorporated by reference.

BACKGROUND OF THE INVENTION

The present invention relates to paper products and, more particularly, to paper products used in crafting items made with paper.

Typical paper crafting kits contain parts, which only allow the paper crafter to assemble a standard A2 sized greeting card requiring the user to obtain a separate standard sized envelope. The space available for numerous signatures from well-wishers is limited. They don't take into consideration that numerous people may want to leave personal messages for the recipient for special life events, such as, retirement, birthdays, baby showers, etc.

While "giant-sized" greeting cards may allow more space for messages, they lack the compact and aesthetically pleasing or formal appearance and do not allow for individual customization.

As can be seen, there is a need for a customized, oversized decorative envelope, suitable for conveying individual greetings and messages to a recipient from a plurality of well-wishers.

SUMMARY OF THE INVENTION

In one aspect of the present invention, gift card comprises: an envelope having a front surface and a back surface joined along a common edge along a binding fold and a closure tab joined to the front surface along a common edge along a closure fold; a first slit defined between an interior surface of the envelope and an exterior surface of the envelope along the binding fold; a second slit defined between the interior surface of the envelope and the exterior surface of the envelope along the closure fold; an insert received in an interior of the envelope; and a ribbon threaded through the first slit and the second slit, such that a first end of the ribbon overlies an exterior surface of the tab and a second end of the ribbon overlies the back surface of the envelope, wherein the ribbon operable to retain the back surface beneath the closure tab with the envelope and closure tab folded in a closed position, and to be retained with the envelope with the envelope in an open position. The binding fold may comprise a first fold and a second fold defining an envelope binding face between the front surface and the back surface.

In some embodiments, the first slit and the second slit are defined such that the ribbon is positioned substantially laterally across the envelope. In other embodiments, the first slit and the second slit are defined such that the ribbon is positioned diagonally across the envelope.

In other aspects of the invention, the insert may comprise a matting layer that is adhered to a layering cardstock and is in turn, adhered to at least one interior face of the envelope. The insert may also comprise a cardstock tab adhered to an interior of the envelope along the binding fold. In certain preferred embodiments, the insert comprises a plurality of cardstock tabs having a crease line defined along a common edge of the cardstock tabs, the cardstock tabs joined along the common edge by a binding and an adhesive. The binding may be joined to an interior of the envelope along an interior surface of the binding face.

Yet another aspect of the invention includes a kit that comprises: a sheet of envelope cardstock; a ribbon; a sheet of layering cardstock; and a sheet of matting cardstock. The kit may also contain a tab cardstock and a binding for joining the tab cardstock, along with an adhesive.

These and other features, aspects and advantages of the present invention will become better understood with reference to the following drawings, description and claims.

BRIEF DESCRIPTION OF THE DRAWINGS

FIG. 1 is a perspective view of an embodiment of the invention shown in a closed position.

FIG. 2 is a perspective view shown in an opened position.

FIG. 2A is a partial perspective view of an alternative embodiment in an opened position.

DETAILED DESCRIPTION OF THE INVENTION

Figure 3:
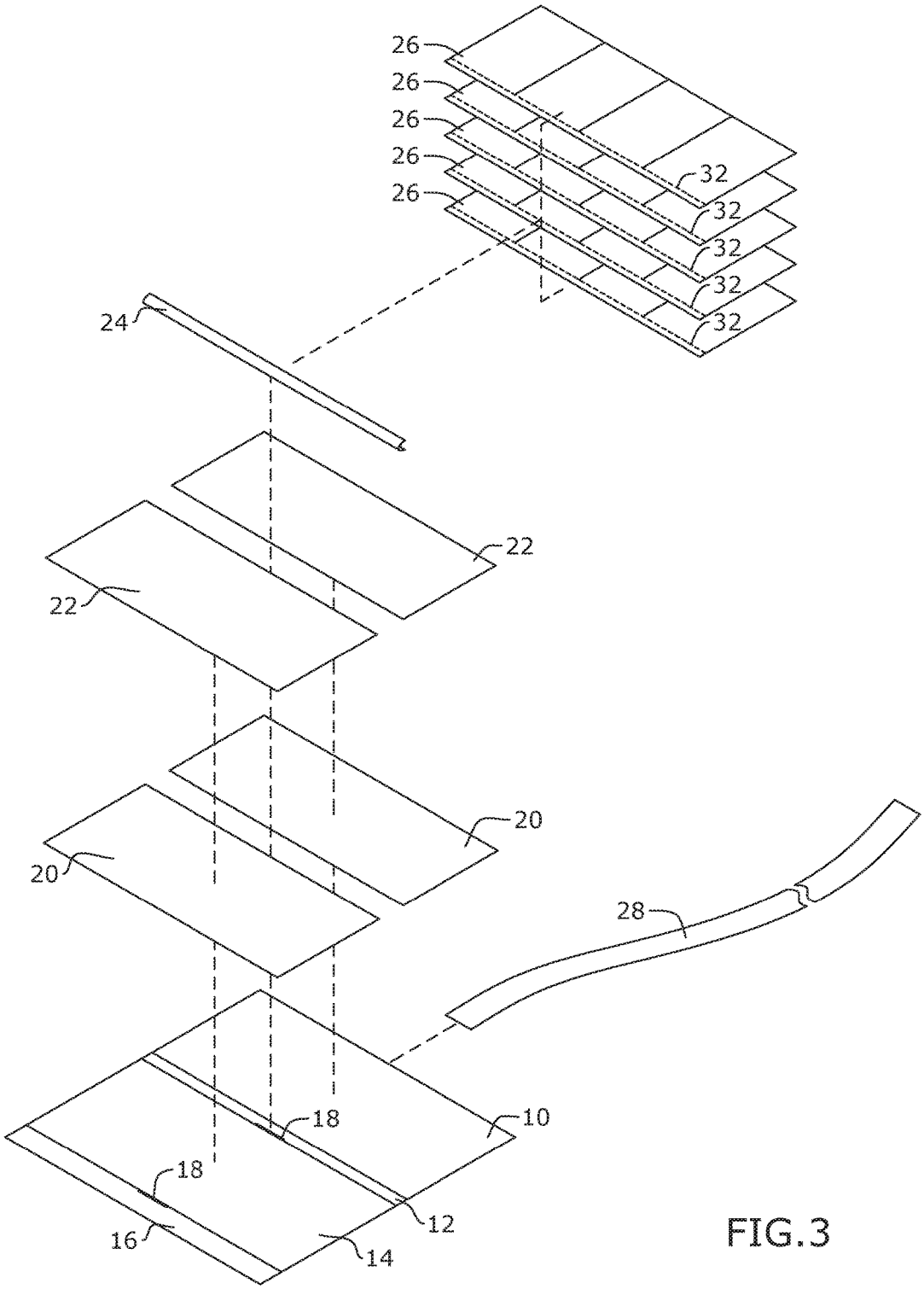
FIG. 3 is an exploded view.
Figure 4:
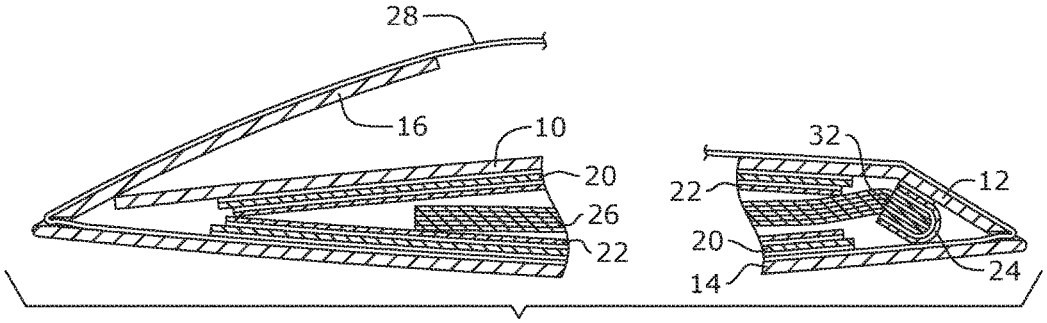
FIG. 4 is a section view of the invention taken from reference line 4-4 in FIG. 1.
Figure 5:
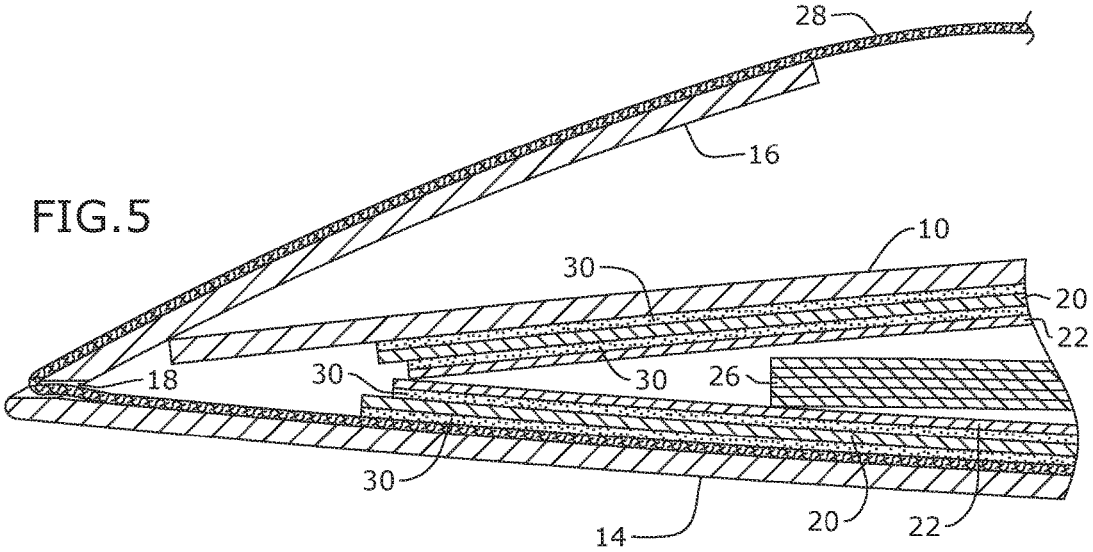
FIG. 5 is an enlarged section view.
Figure 6:
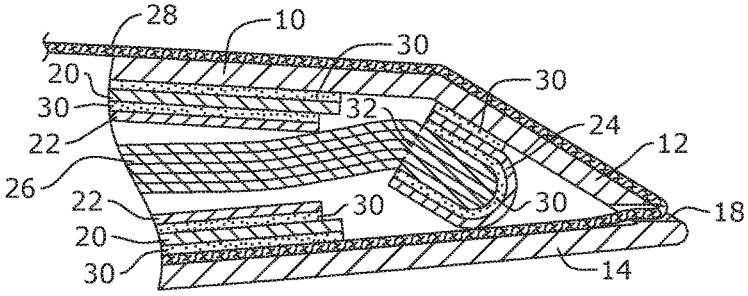
FIG. 6 is an enlarged section view.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a customized, oversized decorative envelope, which contains a booklet of large tabs providing a space for personal messages from a plurality of well-wishers. The invention can be retained by the recipient as a keepsake to memorialize the special life event.

As best seen in reference to FIG. 1, an embodiment of the present invention comprises a sheet of cardstock that may be formed to the shape of an envelope. The envelope has a front surface 10 and a back surface 14, joined along an edge, or binding 12. The edge opposite the binding 12, may be moved between an open and a closed position, like a book or binder. The envelope may be closed along an edge opposite the binding with a closure tab 16 that folds over a front surface 10 of the envelope.

The cardstock may be formed of any desired weight and dimension. For example, a 12 inch square piece of heavy weight cardstock may be cut to size 11¾ inches. The cardstock may be scored in at least two, but preferably three places, to define crease lines for the crafter to conveniently form the envelope with the folds at the correct locations to define the envelope.

By way of a non-limiting preferred embodiment, when the envelope is to be formed with a binding edge 12, opposite to the opening edge, the cardstock may be scored in three places. A first score line and a second score line are defined on an exterior surface, with the first score line at approximately 1 inch and the second score line defined at approximately 7.5 inches from left edge of the cardstock. A third score line is defined on an interior surface of the cardstock, with the score defined at approximately 7.375 (7⅜) inches. This will form an envelope approximately 11.75 inches long and approximately 5.5 inches wide. Slits are cut on two of the score lines at the 1 inch and 7.5 inch locations on the exterior of the card through which the ribbon will be threaded.

The envelope and closure tab 16 may be held in a closed relationship with a length of coordinating ribbon 28. The ribbon 28 may be tied in a knot or a decorative bow to retain the envelope in a closed condition. The colors for the cardstock and the ribbon 28 may be selected with complimentary colors suitable for the occasion for which the envelope is intended.

As seen in reference to FIG. 2 and FIG. 3, a plurality of slots 18 may be cut through the cardstock and the ribbon 28 is threaded through the slots 18 so as to retain the ribbon 28 with the envelope and provide a more formal presentation of the envelope in either the open or the closed position. In some embodiments, the slots 18 may be aligned across the width of the envelope such that the ribbon 28, when threaded, is perpendicular across the face of the envelope. In other embodiments, such as illustrated in reference to FIG. 2A, the slots 18 may be aligned such that the ribbon 28 is presented diagonally across the front face 10 and the back face 14 of the envelope When provided as a component of the kit, the ribbon 28 may be cut to a preferred length for the designed thickness of the envelope and any contents and allow for sufficient length for the knotted closure of the envelope.

The cardstock for the envelope and the ribbon 28 may also be provided as a kit along with one or more inserts. The oversized card-envelope may serve as a base assembly. The inserts may be attached or enclosed within the envelope to form a finished keepsake gift or card. The inserts may include a coordinating matting 20 formed of a cardstock material, which may be adhered to an interior or exterior face of the envelope cardstock. The matting 20 may be provided with a coordinating color, surface texture, or impression, or may be decorated according to the same by the crafter. The inserts may be provided as an individual sheet or a plurality of sheets when incorporated with the other elements of the invention as a kit.

The inserts may also include a layering cardstock 22. The layering weight cardstock 22 may be adhered to the coordinating matting 20 after it has been decorated by the crafter. The layering cardstock 22 may also include an optional ribbon element.

The inserts may also include a booklet formed of one or more large tabs 26 that may be bound with an adhesive layer 30 and a binding 24 and adhered to the inside of the base assembly between the corresponding score lines, preferably along the binding 12. The booklet tabs 26 provide individual spaces for message, and can also be decorated with stamped images and/or embellishments to suit the paper crafter's individual taste.

In certain embodiments, the layering cardstock 22 may be pre-cut and provided with same measurements as the item in photo matting cardstock 20 and adhered to the pre-cut layering weight matte cardstock 22 having the same measurements as the item in matting cardstock 20 and both may then adhered to the inside of the card-envelope base via an adhesive 30.

A third piece of pre-cut layering weight cardstock 22, having approximately the same measurement as the matting cardstock 20, may be adhered to the third piece of pre-cut layering weight matte cardstock 22 and adhered to the inside of the card-envelope base on the side opposite the greeting or sentiment via an adhesive 30. The coordinating ribbon 28 can then be used to close the card-envelope base As seen in reference to FIGS. 3 through 6, an embodiment of the envelope may be formed according to the following. A 12 inch square piece of heavy weight cardstock may be cut to size, scored in three places, and folded to form an envelope approximately 11.75 inches long and approximately 5.5 inches wide. As will be appreciated, the 12 inch square heavy weight cardstock for the base does not necessarily have to be cut down, which will result in the length of the base assembly being 12 inches instead of approximately 11.75 inches as stated above. Any suitable size could be utilized with the dimensions of the score lines, folds, and inserts adjusted accordingly.

Slits 18 may be cut on two of the score lines through which the ribbon will be threaded. The length of the slits 18 can be customized to accommodate the width of the selected coordinating ribbon 28. The front layering cardstock 22 can be adhered to its corresponding matting cardstock 20 and then embellished, stamped, or embossed or likewise decorated according to the paper crafter's or consumer's taste. This decorated assembly layer can then be adhered to the front of the base assembly. The ribbon 28 can then be thread through the slits 18.

The layering cardstock 22 for an inside greeting or sentiment can be likewise decorated to taste and adhered to its corresponding matting cardstock 20. This assembly can then be adhered to the inside of the base assembly. The pre-assembled booklet of tabs 26 can then be adhered to the inside of the base assembly in between the corresponding score lines in the middle fold, or binding 24 of the base assembly. The third set of layering cardstock 22 and its corresponding matte 20, can be assembled and decorated and adhered to the open side of the inside of the assembly opposite the greeting. The ribbon 28 can then be tied in a decorative bow or knot to close the base assembly.

An additional piece of ribbon 28 approximately the same length as the base assembly can be used as a place mark or bookmark for the booklet of tabs 26 so persons leaving messages can easily find the next available tab. The entire assembly can be pre-assembled and pre-decorated and sold to consumers with a theme for any specific life event, i.e., baby shower, birthday, retirement.

In other embodiments, additional tabs 26 can be added to the booklet to hold more space for greetings and messages. If a plurality of tabs 26 are included to form the booklet, a score line 32 may be formed along a common edge of the plurality of tabs 26 and bound with a binding 24 and an adhesive layer 30. A decorative matching box may also be added to hold the completed assembly. The 12 inch square heavy weight cardstock for the base does not necessarily have to be cut down, which will result in the length of the base assembly being 12 inches instead of approximately 11.75 inches as stated above. The greeting on the inside of the card-envelope base assembly can be placed on either side of the inside. Jute twine, string, or decorative cording can also be used instead of ribbon.

It should be understood, of course, that the foregoing relates to exemplary embodiments of the invention and that modifications may be made without departing from the spirit and scope of the invention as set forth in the following claims.

What is claimed is:

1. A gift card, comprising:

an envelope having a front surface and a back surface joined along a common edge along a binding fold and a closure tab joined to the front surface along a common edge along a closure fold, a first slit defined between an interior surface of the envelope and an exterior surface of the envelope along the binding fold;

a second slit defined between the interior surface of the envelope and the exterior surface of the envelope along the closure fold;

an insert received in an interior of the envelope; and a ribbon threaded through the first slit and the second slit, such that a first end of the ribbon overlies an exterior surface of the tab and a second end of the ribbon overlies the back surface of the envelope, wherein the ribbon is operable to retain the back surface beneath the closure tab with the envelope and closure tab folded in a closed position, and to be retained with the envelope with the envelope in an open position.

2. The gift card of claim 1, wherein the binding fold comprises a first fold and a second fold defining an envelope binding face between the front surface and the back surface.

3. The gift card of claim 2, wherein the insert comprises:

a plurality of cardstock tabs having a crease line defined along a common edge of the cardstock tabs, the cardstock tabs joined by a binding and an adhesive.

4. The gift card of claim 3, wherein the insert comprises:

the binding joined to an interior of the envelope along an interior surface of the binding face.

5. The gift card of claim 1, wherein the first slit and the second slit are defined such that the ribbon is positioned substantially laterally across the envelope.

6. The gift card of claim 1, wherein the first slit and the second slit are defined such that the ribbon is positioned diagonally across the envelope.

7. The gift card of claim 1, wherein the insert comprises:

a matting layer adhered to a layering cardstock and adhered to at least one interior face of the envelope.

8. The gift card of claim 7, wherein the insert comprises:

a cardstock tab adhered to an interior of the envelope along the binding fold.

9. A gift card, comprising:

an envelope having a front surface and a back surface joined along a common edge of a binding fold and a closure tab formed along a closure fold defined along an edge of the envelope opposite the binding fold, a first slit defined between an interior surface of the envelope and an exterior surface of the envelope along the binding fold;

a second slit defined between the interior surface of the envelope and the exterior surface of the envelope along the closure fold;

an insert received in an interior of the envelope;

a matting layer adhered to a layering cardstock and adhered to at least one interior face of the envelope; and a ribbon threaded through the first slit and the second slit, wherein the ribbon is operable to retain the front surface and the closure tab in a closed position, and the ribbon is retained with the envelope in an open position.

10. The gift card of claim 9, wherein the binding fold comprises a first fold and a second fold defining an envelope binding face between the front surface and the back surface.

11. The gift card of claim 10, wherein the insert comprises:

a plurality of cardstock tabs having a crease line defined along a common edge of the cardstock tabs, the cardstock tabs joined by a binding and an adhesive.

12. The gift card of claim 11, wherein the insert comprises:

the binding joined to an interior of the envelope along an interior surface of the binding face.

13. The gift card of claim 9, wherein the first slit and the second slit are defined such that the ribbon is positioned substantially laterally across the envelope.

14. The gift card of claim 9, wherein the first slit and the second slit are defined such that the ribbon is positioned diagonally across the envelope.

15. The gift card of claim 9, wherein the insert comprises:

a cardstock tab adhered to an interior of the envelope along the binding fold.

* * * * *